United States Patent [19]

Snyder

[11] Patent Number: 4,523,602

[45] Date of Patent: Jun. 18, 1985

[54] PRESSURE CONTROLLER

[75] Inventor: David E. Snyder, Longview, Tex.

[73] Assignee: Axelson, Inc., Longview, Tex.

[21] Appl. No.: 516,360

[22] Filed: Jul. 22, 1983

[51] Int. Cl.[3] ..... F16K 17/00

[52] U.S. Cl. ..... 137/467; 137/458; 137/463; 137/624.27; 251/73; 251/74

[58] Field of Search ..... 137/456, 458, 461, 463, 137/624.27, 467; 251/73, 74

[56] References Cited

U.S. PATENT DOCUMENTS

| | | | |
|---|---|---|---|
| 2,686,528 | 8/1954 | Snyder | 251/73 X |
| 2,902,046 | 9/1959 | Dollison | 137/467 |
| 3,389,718 | 6/1968 | Johnson | 137/458 X |
| 4,015,627 | 4/1977 | Bower | 137/467 X |
| 4,017,053 | 4/1977 | Wells | 137/458 X |
| 4,073,466 | 2/1978 | Snyder | 137/624.27 X |

FOREIGN PATENT DOCUMENTS

| | | | |
|---|---|---|---|
| 2915280 | 10/1980 | Fed. Rep. of Germany | 251/73 |

*Primary Examiner*—Robert G. Nilson

*Attorney, Agent, or Firm*—Hubbard, Thurman, Turner & Tucker

[57] ABSTRACT

Disclosed is a pressure controller for sensing changes in a service pressure and controlling a control pressure in response to such changes. The pressure controller includes a valve body having a control inlet and a bleed outlet with a passage therebetween. A valve seat is positioned in the passage and a valve member is reciprocatingly mounted in the valve body for movement between a closed position in engagement with the valve seat and an open position out of engagement with the valve seat. The controller includes a releasable latch for latching the valve member in the closed position. The controller includes a release mechanism for releasing the latch in response to changes in service pressure to allow the valve member to move to the open position.

21 Claims, 12 Drawing Figures

PRESSURE CONTROLLER

BACKGROUND OF THE INVENTION

The present invention relates generally to the field of systems and apparatus for controlling the flow of fluid through flowlines in response to changes in service pressure within the flowlines, and more particularly, to a pressure controller that is adapted to sense changes in service pressure and control a control pressure in response to such changes, wherein the control and sense functions are independent of each other and wherein the control function is capable of operating at very high pressures.

DESCRIPTION OF THE PRIOR ART

In the past, various systems have been developed to control the flow the fluid through a flowline when the pressure in the flowline is less than or greater than a predetermined maximum or minimum. One such system, which is described in U.S. Pat. No. 3,043,331, includes a control system that supplies pressurized fluid to an actuator that holds a valve inserted in the flowline in a normally open position. A pair of pilot valves is connected to the system and adapted to sense pressure and vent the control system when the line pressure is greater than or less than the maximum or minimum. The venting of the control system causes the actuator to allow the safety valve to close.

An example of a pilot valve adapted for use in such a system is disclosed in U.S. Pat. No. 4,091,832. The pilot valve includes a valve body having spaced apart inlet, outlet, and bleed ports that communicate with a bore. The valve includes a spool slidingly mounted in the bore and having spaced apart O-ring type seals. The spool is movable between a first position in which the inlet and outlet ports are communicated and the bleed port is blocked and a second position in which the outlet and bleed ports are communicated but the inlet port is blocked. The spool is urged in one direction by a spring and in the other direction by a piston which is exposed to service pressure.

Most sensors or pilot valves of the type described above are adapted to control only low pressures. Accordingly, in order to control higher pressures, there have been developed systems that include interfacing valves to control high pressures. Such interfacing valves are commonly called relays, and systems including such relays are disclosed, for example, in U.S. Pat. No. 3,877,484, U.S. Pat. No. 3,963,050, and U.S. Pat. No. 4,074,702. Such relays are pressure operated three-way block and bleed valves that are adapted to shift when they receive a signal from a sensor or pilot valve. Additional relay type valves are disclosed, for example, in U.S. Pat. No. 3,823,739, U.S. Pat. No. 4,073,466, and U.S. Pat. No. 4,074,688.

One shortcoming of all of the above described valves and systems is in that they all include a spool, or the like, which moves longitudinally in a bore and which forms seals by means of O-rings or the like. The O-ring seals frictionally engage the bores of the valves and the magnitude of the frictional engagement is substantially directly proportional to the pressure differential on either side of the O-ring. In high pressure applications, O-ring friction affects greatly the reliability and repeatability of the valve. Thus, such valves are best suited to relatively low pressure application. And additional, but related shortcoming of such valves is in that O-rings have a tendency to extrude and fail in high pressure applications.

Alternative pilot valve arrangements are disclosed in related U.S. Pat. Nos. 4,017,053, 4,026,326, and in U.S. Pat. No. 3,026,904. All of those three patents disclose two-way, bleed-only, pilot valves that are operated by a longitudinally movable cam. The pilot valve of the U.S. Pat. Nos. 4,017,053 and 4,026,326 operate by pressure a three-way block and bleed relay.

It is an object of the present invention to provide a pressure controller that overcomes the shortcomings of the prior art.

More specifically, it is an object of the present invention to provide a pressure controller that is reliable and repeatable at high pressures.

It is a further object of the present invention to provide a pressure controller that eliminates the need for separate sensors and relays and associated sources of separate control and instrument pressure.

It is a further object of the present invention to provide a pressure controller that includes built in manual override functions.

It is a further object of the present invention to provide a pressure controller that may be reset only manually and which will not reset automatically.

SUMMARY OF THE INVENTION

The foregoing and other objects are accomplished by the pressure controller of the present invention. In its broadest aspect, the pressure controller of the present invention includes a valve body having a control inlet and bleed outlet. A valve seat is positioned in a passage between the control inlet and the bleed outlet. A valve member is reciprocally mounted in the valve body for movement between a closed position in engagement with the valve seat to block communication between the control inlet and the bleed outlet and an open position out of engagement with the valve seat. Means are provided for releasably latching the valve member in the closed position. Means are also provided for releasing the latch means in response to a change in service pressure to allow the valve member to move to the opened position.

The latch means includes a detent recess formed in the valve body. A detent is movably carried with the valve member and a trigger is provided for urging the detent into engagement with the detent recess when the valve member is in the closed position. Pressure generated forces tending to urge the valve member out of engagement with the seat are transmitted from the valve member to the valve body by the engagement of the detent with the detent recess.

The release means of the present invention includes an instrument body mounted adjacent the valve body. A piston is reciprocatingly mounted in the instrument body and is exposed to service pressure received in the instrument body through a sense inlet. An operator is longitudinally movably mounted in the instrument body for movement with the piston. A spring is provided for urging the operator and piston in the direction opposite the force due to the service pressure acting on the piston. The operator includes a cam portion that engages a cam follower that is operably connected with the trigger of the latch means. When service pressure varies from its intended range, the operator moves longitudinally, thereby causing the cam portion to move the cam follower and trigger. Movement of the trigger allows the detent to become disengaged from the detent recess in the valve body. With the detent so disengaged, pressure forces move the valve member to the open position.

Means are provided for resetting or reclosing the valve member. Preferably, the resetting or reclosing means includes a reset yoke that is operable from exterior of the valve and instrument bodies. The reset yoke is engageable with the valve member to urge the valve member into engagement with the seat. If the service pressure is within the desired range, the trigger will operate to urge the detent into engagement with the detent recess. Means are also provided for manually opening the valve when the service pressure is within the desired range. Preferably, the opening means includes a trip yoke having a portion extending exterior of the valve and instrument bodies and a portion engageable with the trigger.

In another aspect of the present invention, the pressure controller may include a control outlet in communication with the passage between the valve seat and the control inlet. In such embodiment, the pressure controller includes a second valve seat positioned in the passageway between the control inlet and the control outlet and a second valve member reciprocatingly mounted in the passage for movement between a closed position and engagement with the second valve seat to block communication between the control inlet and the control outlet and an open position out of engagement with the second valve seat to allow communication between the control inlet and the control outlet. In such embodiment, the pressure controller includes means for holding the second valve member in the open position when the first recited valve member is in the closed position and for allowing the second member to move the closed position when the first valve member moves to the open position. Such embodiment thereby provides a three-way block and bleed arrangement in that when the first valve member is closed, thereby blocking communication to the bleed outlet, the second valve member is open, thereby allowing communication from the control inlet to the control outlet. On the other hand, when the first valve member is open and the second valve member is closed, communication from the control inlet to the control outlet is blocked, but communication from the control outlet to the bleed outlet is allowed.

BRIEF DESCRIPTION OF THE DRAWINGS

FIG. 12 is a sectional view of a high-low three-way block and bleed embodiment of the pressure controller of the present invention.

DESCRIPTION OF THE PREFERRED EMBODIMENT

Figure 1:
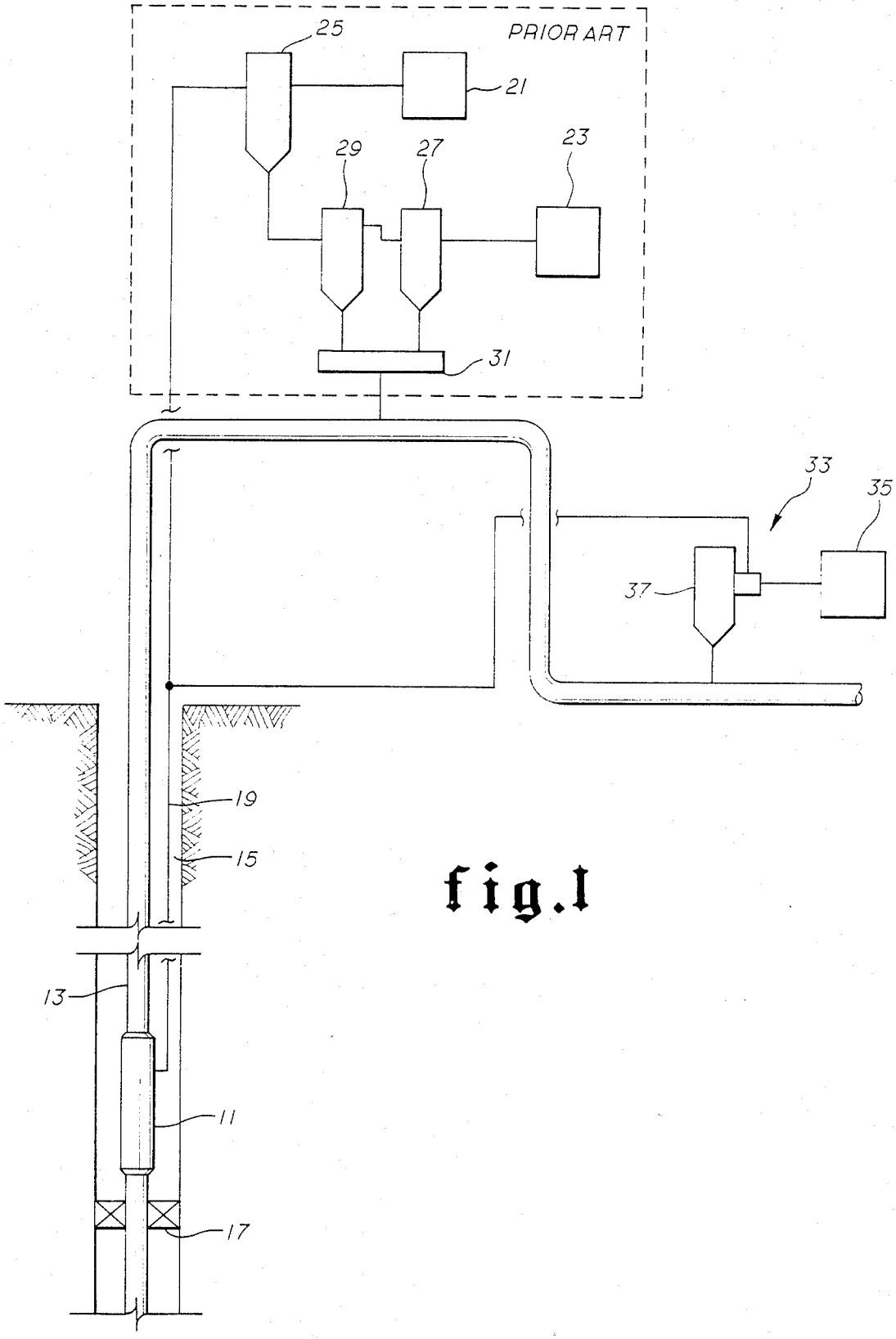
FIG. 1 is a schematic view showing a system embodying the pressure controller of the present invention in comparison with system of the prior art.

Referring now to the drawings, a subsurface safety system including a pressure controller of the present invention is illustrated schematically and compared with a system of the prior art. The subsurface safety system includes a subsurface safety valve included in a string of tubing 13 in the well bore 15 at some point below the surface. A packer 17 is provided for packing off the annulus exterior of tubing string 13. Subsurface safety vavles of the type of subsurface safety valve 11 are commercially available and generally well known.

Subsurface safety valve 11 is held in the open position by high pressure hydraulic fluid supplied thereto through a line 19. Hydraulic fluid is supplied to line 19 by a control system, which is adapted to sense the pressure of the fluid flowing out of the well through tubing 13 and maintain the supply of hydraulic pressure to subsurface safety valve 11 as long as the pressure is above a predetermined minimum or below a predetermined maximum. If the pressure varies from the predetermined range, then the control system is adapted to relieve the hydraulic pressure supplied to subsurface safety valve 11 and allow it to close.

A typical control system of the prior art is enclosed in dashed lines in FIG. 1. The prior art system includes a high pressure hydraulic supply 21 and a low pressure pneumatic instrument supply 23. High pressure hydraulic control supply 21 supplies hydraulic fluid to subsurface safety valve 11 through a relay 25. Instrument pressure is supplied to relay 25 by low pressure instrument supply 23 through a high pressure sensor 27 and a low pressure sensor 29. Sensors 27 and 29 are connected to receive tubing pressure through a manifold system 31. As long as tubing pressure remains within the predetermined pressure range, sensors 27 and 29 remain in the inservice position to supply instrument pressure to relay 25. If, however, tubing pressure varies outside the predetermined range, then sensor 27 or sensor 29 will shift and bleed instrument pressure from relay 25, whereupon relay 25 will shift to bleed hydraulic pressure from subsurface safety valve 11, which will allow subsurface safety valve 11 to close. Relays of the type of relay 25 normally have a manual override feature, which allows subsurface safety valve 11 to be closed manually, and a lockout and manual reset feature, which prevents relay 25 from automatically returning to the reset position after it has tripped.

A control system which includes the pressure controller of the present invention is designated generally by the numeral 33. Control system 33 includes a high pressure hydraulic control supply 35 which supplies high pressure hydraulic fluid to subsurface safety valve 11 through a pressure controller 37. As will be explained in detail hereinafter in connection with the embodiments of the invention disclosed in FIGS. 8–12, pressure controller 37 is adapted for connection to receive and sense tubing pressure and to relieve controlled pressure from subsurface safety valve 11 when tubing pressure is either too high or too low. It is readily apparent that the control system that includes pressure controller 37 of the present invention is much simpler than that of the prior art in that is does not include separate instrument and control supplies or separate sensors and relays.

Figure 2:
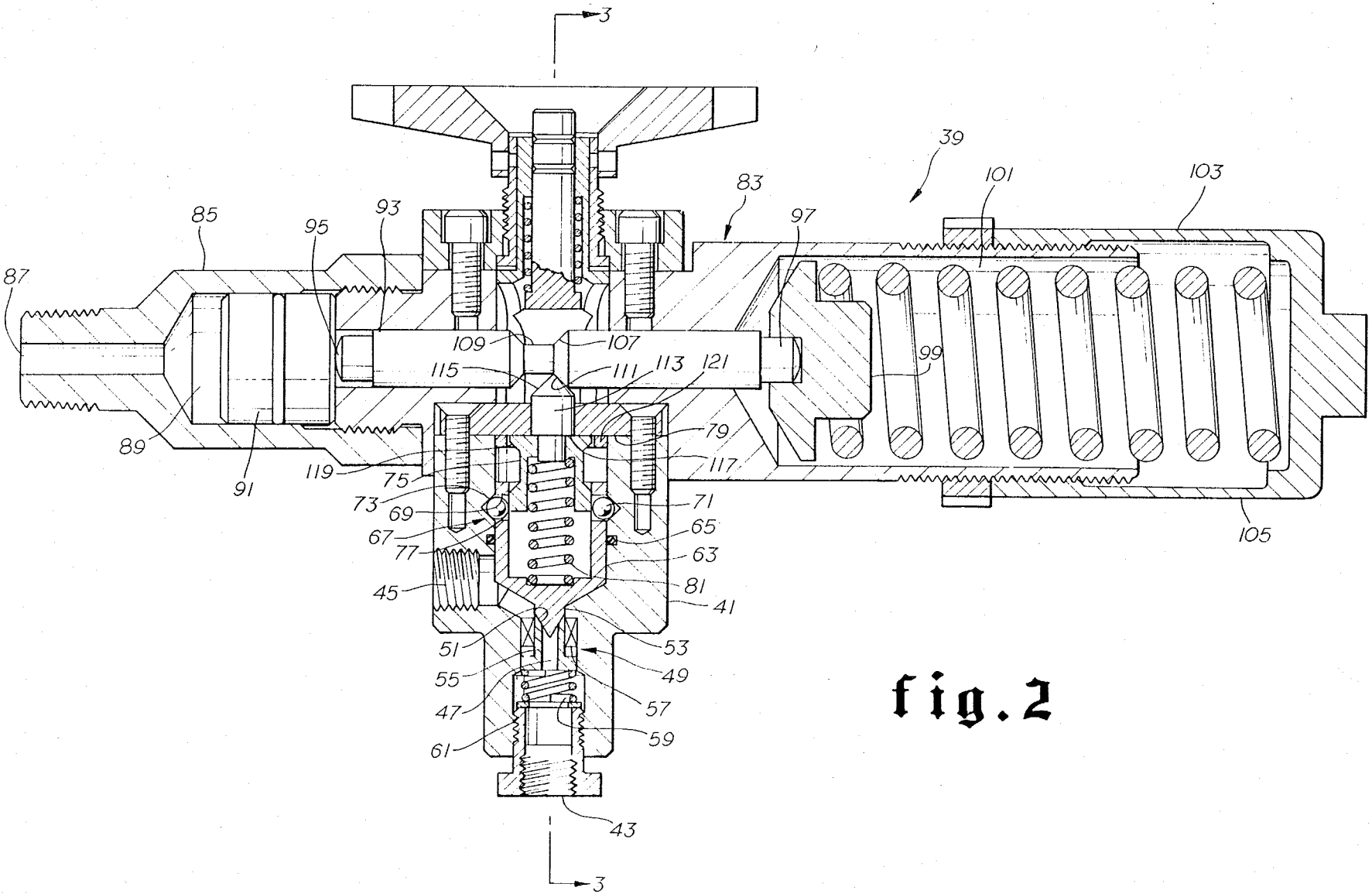
FIG. 2 is side section view of a two way, bleed only, embodiment of the pressure controller of the present invention.

Referring now to FIG. 2, one embodiment of the pressure controller of the present invention is designated generally by the numeral 39. The embodiment of FIG. 2 is a high or low, two-way bleed-only hydraulic controller. Pressure controller 39 includes a valve body 41 having a control inlet 43 and a bleed outlet 45. Control inlet 43 and bleed outlet 45 are intercommunicated by a passageway 47 which, when pressure controller 39 is in service, is closed by a valve designated generally by the numeral 49.

Valve 49 includes a seat 51 and a valve member 53. Seat 51 is formed at the inner end of a tubular member 55 which is sealingly slidingly mounted within valve body 41. Preferably, the sliding seal is provided by a cup type seal shown schematically at 57. Tubular member 55 is biased inwardly toward valve member 53 by a spring 59 which is held in valve body 41 by a spring retainer 61. Additionally, pressure forces received at control inlet 43 act to urge tubular portion 55 inwardly to firmly engage seat 51 with valve member 53.

Valve member 53 includes a relatively large diameter tubular detent carrier 63 which is slidingly sealingly mounted within valve body 41. The sliding seal is preferably accomplished by an O-ring 65. The diameter of detent carrier 63 is substantially greater than the diameter of valve member 53 within seat 51. Thus, when valve member 53 becomes unseated, the forces acting on valve member 53 are multiplied to drive valve member 53 forcefully to the open position.

Valve member 53 is releasably latched in the closed position by a latch designated generally by the numeral 67. Latch 67 includes detent carrier 63 which has therein a plurality of detent apertures 69. Each detent aperture 69 carries a detent ball 71. Detent balls 71 are radially inwardly and outwardly movable in detent apertures 69. Valve body 41 includes an annular detent recess 73 which is adapted to receive detent balls 71 when valve member 53 is in the closed position. Detent balls 71 are held into detent recess 73 by a spool-shaped trigger 75. Trigger 75 includes a radially outwardly facing shoulder 77 which engages detent balls 71 into detent recess 73. Trigger 75 is biased axially upwardly against a stop bar 79 by a spring 81. When trigger 75 is in contact with stop bar 79, shoulder 77 registers with detent recess 73 to latch valve member 53 closed. Pressure forces tending to open valve member 43 are transmitted through detent carrier 63 and detent balls 71 into detent recess 73.

Latch 67 is released to allow valve 49 to open by means of release means designated generally by the numeral 83. Release means 83 includes an instrument body 85 which includes a service inlet 87. Service inlet 87 communicates service pressure to a cylindrical chamber 89 within instrument body 85. Chamber 89 has slidingly sealingly mounted therein a piston 91 that is acted on by service pressure.

Release means 83 includes an elongated cylindrical operator 93 longitudinally slidingly mounted within instrument body 85. Operator 93 includes a first end 95 that abuts piston 91 and a second end 97. Second end 97 abuts a spring pad 99 which compresses a spring 101 within a spring chamber formed at one end of instrument body 85. Spring chamber 103 is formed by a cap 105 that is threadedly engaged with the exterior of instrument body 85 so as to be axially movable to vary the compression of spring 101.

Operator 93 includes a cam portion 107 intermediate ends 95 and 97. Cam portion 107 includes a reduced diameter portion 109 and a conical camming surface 111. A cam follower 113 is axially slidingly mounted through stop bar 79 and includes a conical portion 115 which engages cam portion 107 of operator 93 and a shoulder 117 which engages trigger 75.

Figure 4:
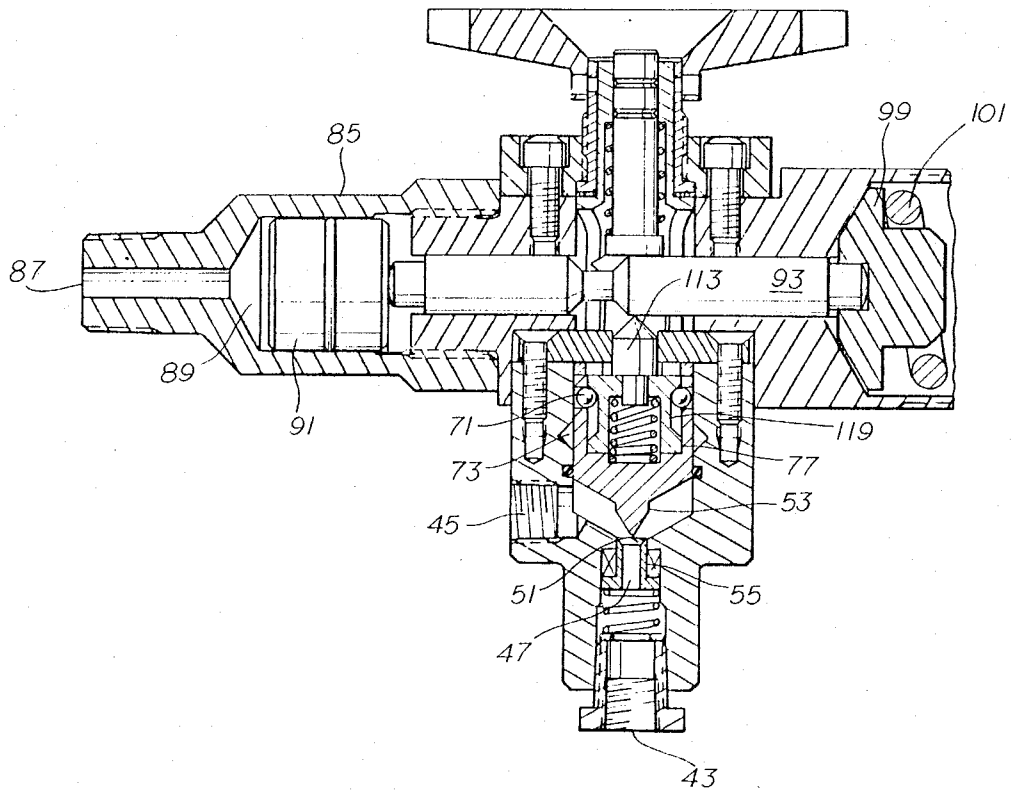
FIG. 4 is a fragmentary sectional view similar to FIG. 2 with the valve of the pressure controller of the present invention in the open position.

Spring 101 biases operator 93 leftward as shown in FIG. 2 against the force generated by service pressure acting on piston 91. The embodiment shown in FIG. 2 acts as a low sensor in that as long as service pressure remains above a predetermined minimum piston 91 and operator 93 wil remain in the position shown in FIG. 2. If, however, service pressure drops below the predetermined minimum, the force of spring 101 will urge operator 93 and piston 95 leftward. Such leftward movement of operator 95 will be transmitted to caming surface 11 to cam follower 113 and cause cam follower 113 to move axially downwardly. Such axially downward movement of cam follower 113 is transmitted to trigger 75, which in turn moves shoulder 77 axially out of register with detent balls 71. With shoulder 77 so moved, detent balls 71 are no longer restrained against radial movement and are free to move radially inwardly into a recess 119 in trigger 75. Such inward movement of detent balls 71 allows valve member 53 to move axially upwardly into engagement with a stop ring 121 to the open position, as shown in FIG. 4.

While the embodiment shown in FIG. 2 operates as a low sensor, it will be recognized that pressure controller 39 may operate as a high sensor by reversing the ends of operator 93 such that end 97 abuts piston 91 and end 95 abuts spring pad 99.

Figure 3:
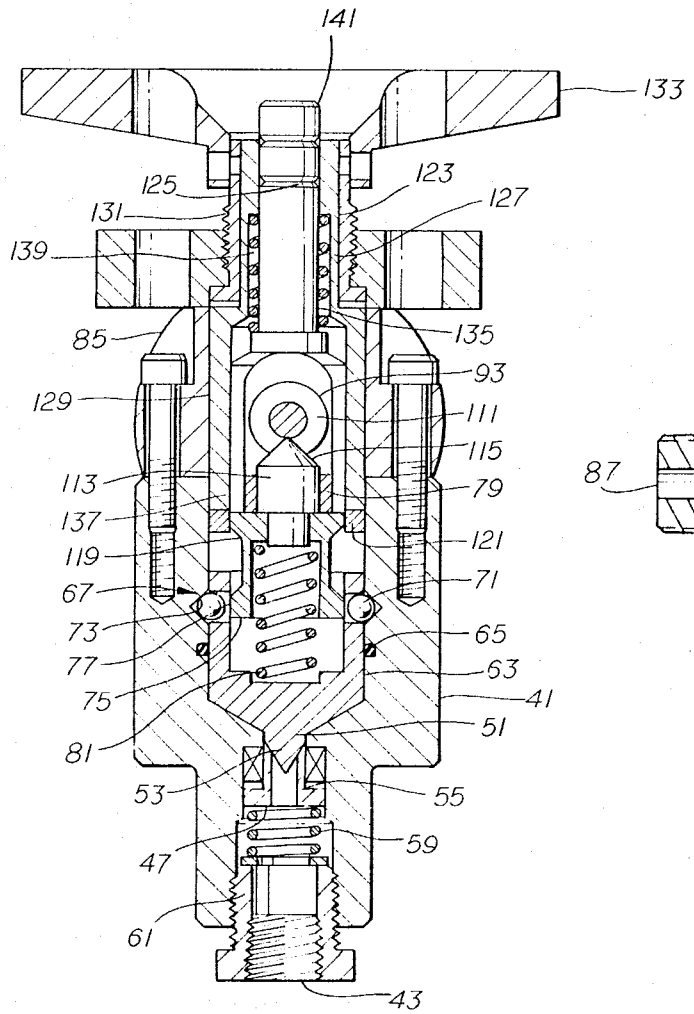
FIG. 3 is a sectional view taken along line 3—3 of FIG. 2.

Referring now specifically to FIG. 3, means are provided for manually manipulating valve member 53 and trigger 75 exterior of valve body 41 and instrument body 85. More specifically, a reset yoke 123 is provided for manipulating valve member 53 and a trip yoke 125 is provided for manipulating trigger 75.

Reset yoke 123 includes a tubular upper portion 127 and a pair of depending legs 129. Tubular portion 127 extends generally outwardly of instrument body 85 and is mounted within a nut 131 threadedly engaged with instrument body 85 for movement inwardly and outwardly thereof. A hand wheel 133 is connected to nut 131 so that nut 131 may be more readily rotated to move reset yoke 123 inwardly.

Legs 129 of reset yoke 123 generally straddle operator 93 and extend into valve body 41 to contact stop ring 121. When valve member 53 is in the open position, as shown in FIG. 5, inward movement of reset yoke 123 moves valve member 53 toward the closed position.

Trip yoke 125 likewise includes a cylindrical upper portion 135 and a pair of downwardly depending legs 137. Upper portion 135 of trip yoke 125 is slidingly mounted within tubular portion 127 of reset yoke 123. A spring 139 is positioned to bias trip yoke 125 axially downwardly with respect to reset yoke 123 to urge legs 137 into engagement with trigger 75. Spring 139 is selected to be weaker than spring 81 so as not to cause inadvertent tripping of latch 67. If, however, it is desired to manually cause valve member 53 to move to the open position, the outwardly extending end 141 of trip yoke 125 may be pushed inwardly, thereby to move trigger 75 out of engagement with detent balls 71.

Figure 7:
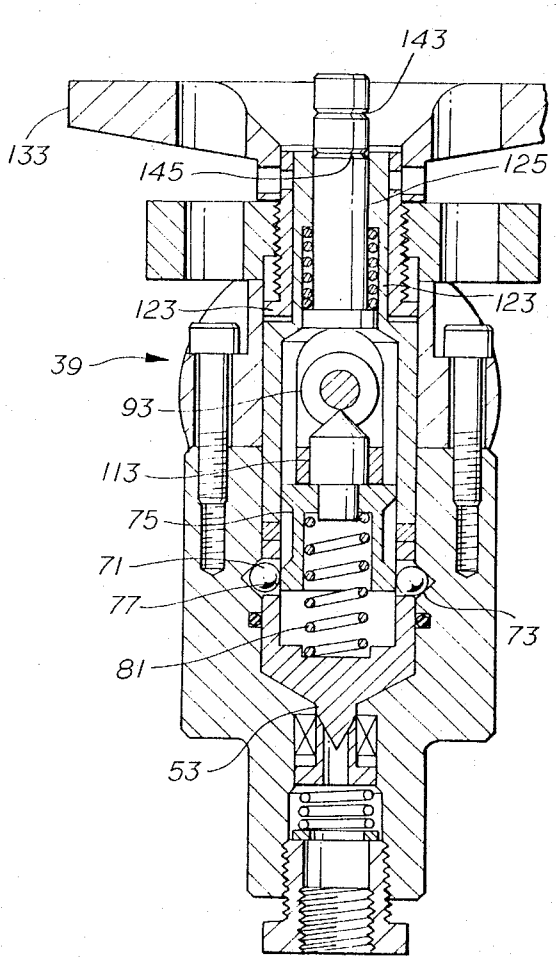
FIG. 7 is a sectional view similar to FIG. 6, but with the service pressure within the desired range.
Figure 6:
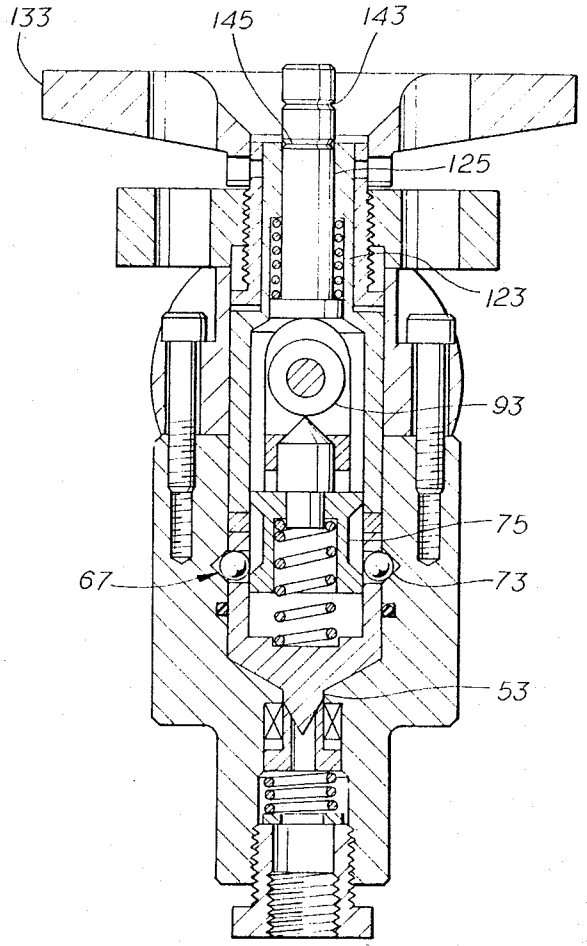
FIG. 6 is a sectional view similar to FIG. 5 showing the valve of the pressure controller of the present invention moved manually to the closed positioned, but with service pressure outside the desired range.
Figure 5:
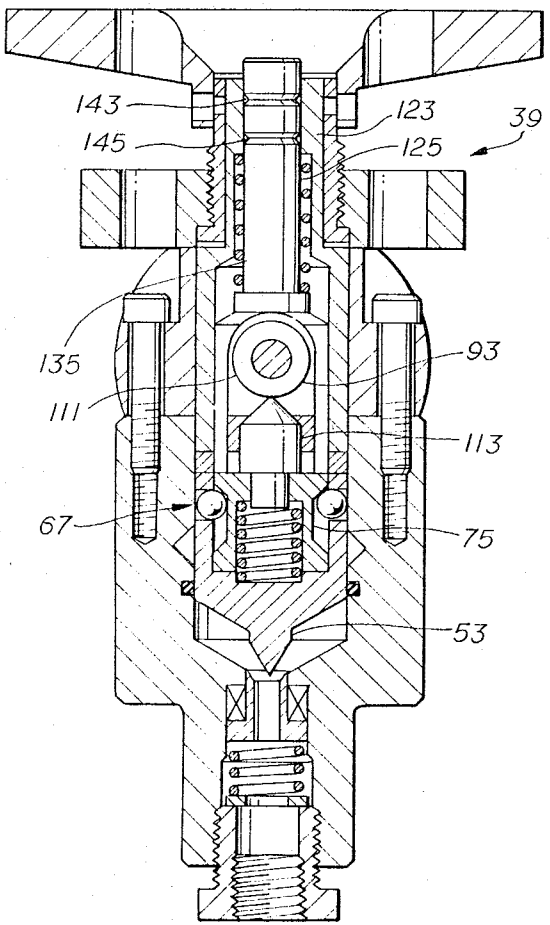
FIG. 5 is a sectional view similar to FIG. 3 with the valve of the pressure controller of the present invention in the open position.

Referring now to FIGS. 5–7, there is shown the sequence of returning valve member 53 from the open position to the closed position. In FIG. 5, valve member 53 is open and service pressure is outside the predetermined range. Accordingly, cam follower 113 is shown urged axially downwardly by cam surface 111 and is in engagement with the maximum outside diameter of operator 93. It will be noted that upper portion 135 of trip yoke 125 includes an upper indicator mark 143 and an axially spaced apart lower indicator mark 145. When pressure controller 39 is in service, as shown for example in FIG. 3, upper indictor mark 143 is substantially even with the end of reset yoke 123. Since trip yoke 125 is urged continually into engagement with trigger 75, trip yoke 125 provides an indication of the position of trigger 75. Thus, in FIG. 5, upper indicator mark 143 is within reset yoke 123, thereby to indicate that latch 67 has tripped and service pressure is outside the predetermined range.

Referring now to FIG. 6, handwheel 133 and reset yoke 123 are shown in the axially inward position with valve member 53 thereby moved to the closed position. However, operator 93 is still in the out of service position. Thus, trigger 75 is prevented from moving axially outwardly into registry with detent recess 73 and latch 67 will not reset. The condition depicted in FIG. 6 is externally indicated by reference to the end of trip yoke 125, wherein the outer end of reset yoke 123 is approximately midway between upper indicator mark 143 and lower indicator mark 145.

In FIG. 7, handwheel 133 and reset yoke 123 are again in the inward position with valve member 53 closed. However, operator 93 has returned to the in service position thereby allowing cam follower 113 and trigger 75 to be urged upwardly by spring 81. Outwardly facing shoulder 77 of trigger 75 is thus in registry with detent recess 73 thereby urging detent balls 71 radially outwardly into engagement therewith. The position of trigger 75 is indicated by the exposure of both upper indicator mark 143 and lower indicator mark 145 of trip yoke 125. Outward movement of handwheel 133 and reset yoke 123 returns pressure controller 39 to the in service position as shown, for example, in FIG. 3.

Figure 8:
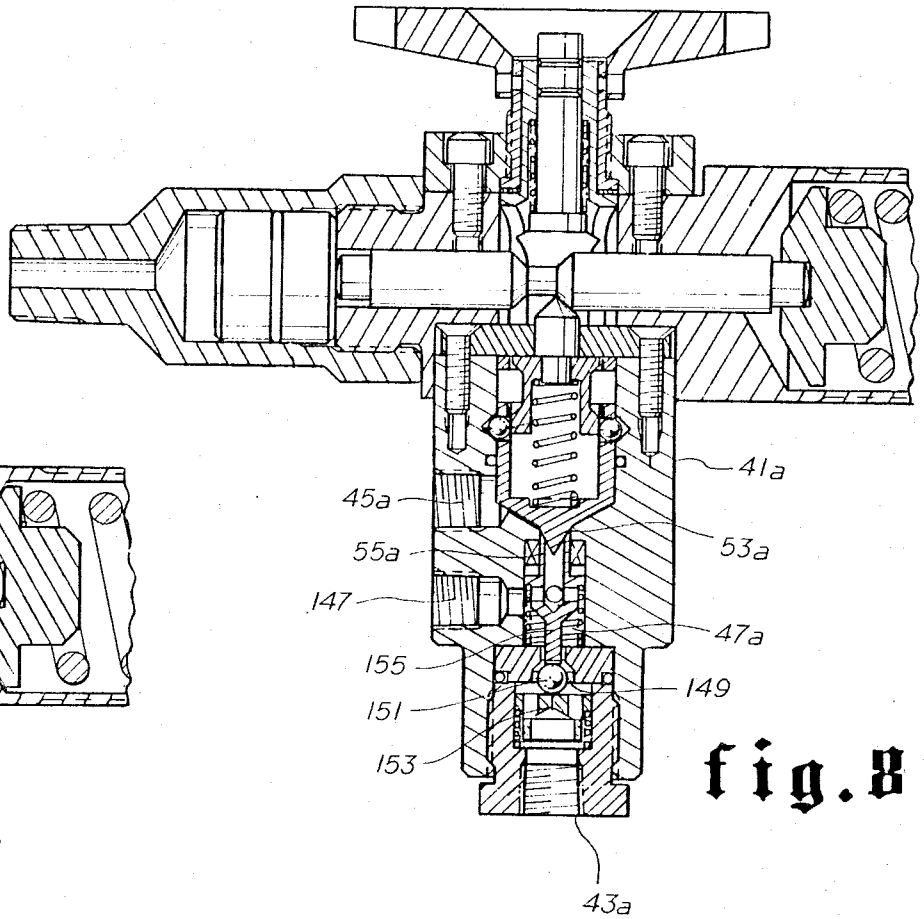
FIG. 8 is a sectional view of a three-way block and bleed embodiment of the pressure controller of the present invention.
Figure 9:
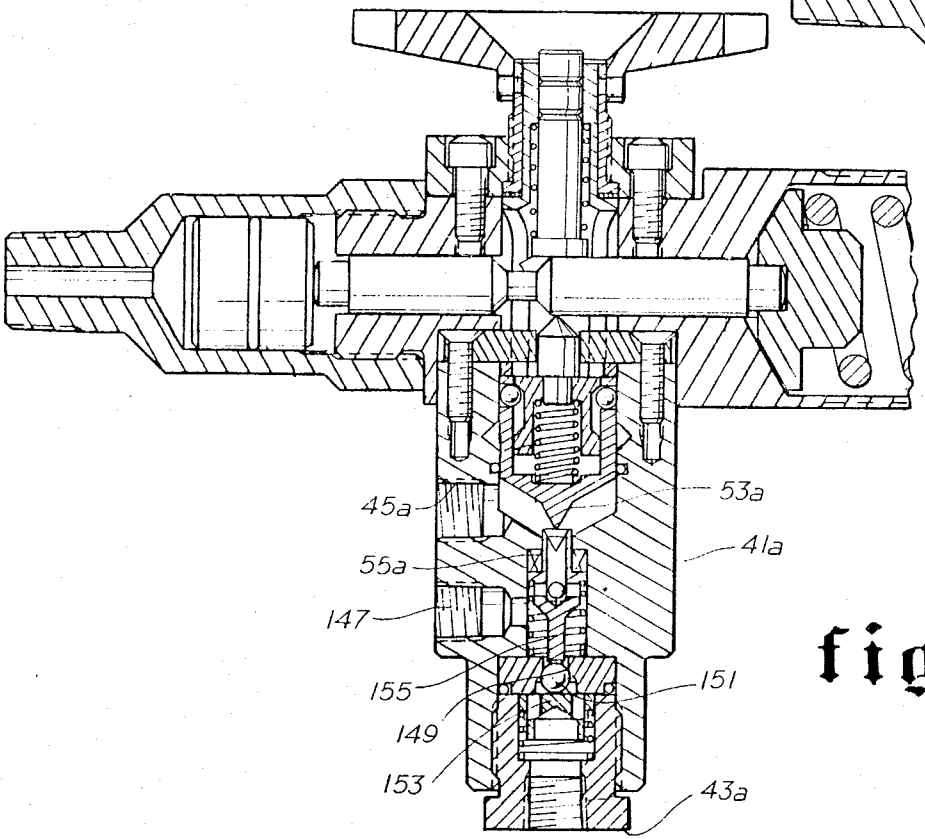
FIG. 9 is a fragmentary sectional view of the embodiment of FIG. 8 in the bleed position.

Referring now to FIGS. 8 and 9, there is shown a preferred embodiment of the pressure controller of the present invention as a high or low three-way block and bleed hydraulic controller. The latch and release means of the embodiment of FIGS., 8 and 9 are substantially the same as those described above. However, the embodiment of FIGS. 8 and 9 includes a valve body **41*a* that includes, in addition to a control inlet 43*a* and a bleed outlet 45*a*, a control outlet 147**.

Valve body **41*a* includes a passage 47*a* that intercommunicates control inlet 43*a* with control outlet 147 and bleed outlet 45*a*. A second valve seat 149 is positioned in passageway 47*a* between control inlet 43*a* and control outlet 147. A second valve member, which in the embodiment of FIGS. 8 and 9 is a ball 151, is positioned in passageway 47*a* and is adapted to close by seating on second valve seat 149. Ball 151 is retained by a spring-loaded ball retainer 153** having a plurality of flow passages therethrough.

Tubular member **55*a* includes a downwardly extending rod or stinger 155. Stinger 155 extends through second seat 149 and into contact with ball 151. When valve member 53*a* is closed, as shown in FIG. 8, tubular portion 55*a* and stinger 155 are urged downwardly to hold ball 151 off seat 149. Thus, in FIG. 8, there is communication between control inlet 43*a* and control outlet 147, but bleed outlet 45*a* is blocked. However, as shown in FIG. 9, when valve member 53*a* is in the open position, tubular portion 55*a* and stinger 155 move upwardly to allow ball 151 to seat on seat 149. Thus, in FIG. 9, control inlet 43*a* is blocked, but control outlet 147 and bleed outlet 45*a*** are communicated.

Figure 11:
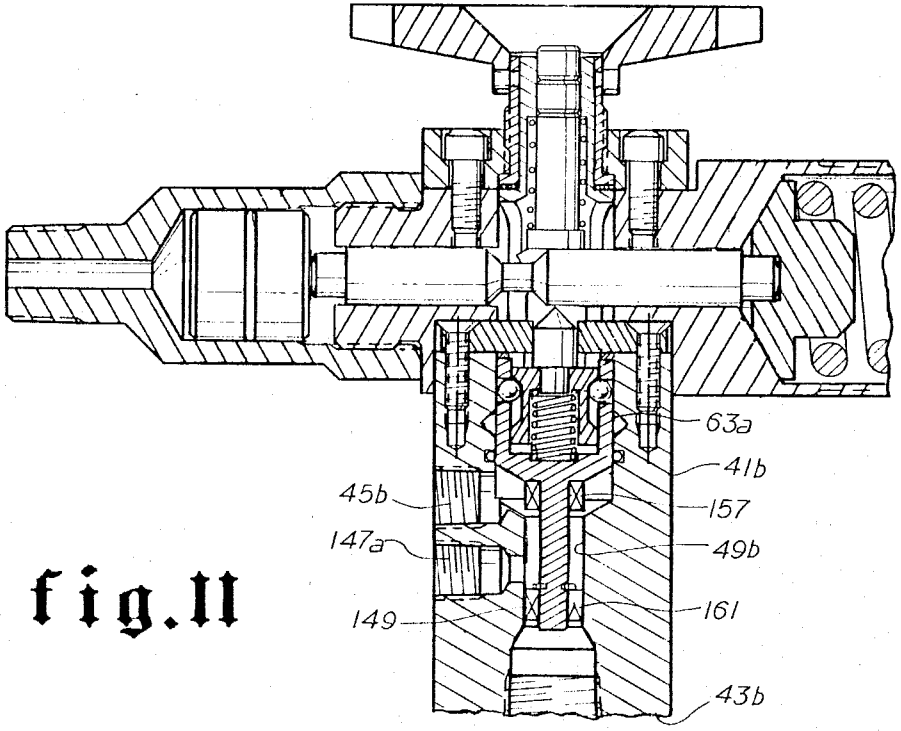
FIG. 11 is a fragmentary sectional view of the embodiment of FIG. 10 in the bleed position.
Figure 10:
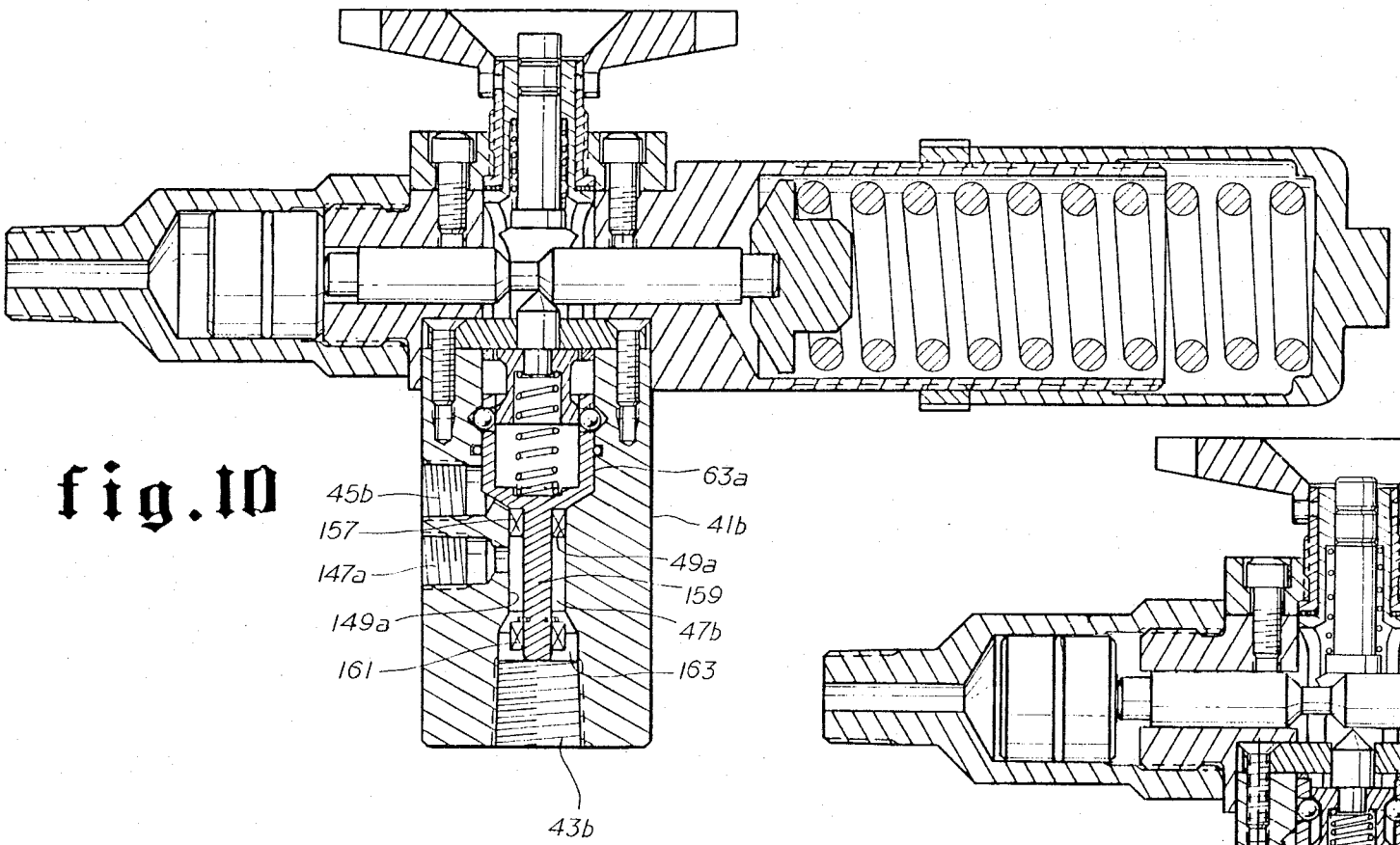
FIG. 10 is a sectional view of an alternative embodiment of the three-way block and bleed embodiment of the present invention.
Figure 17:
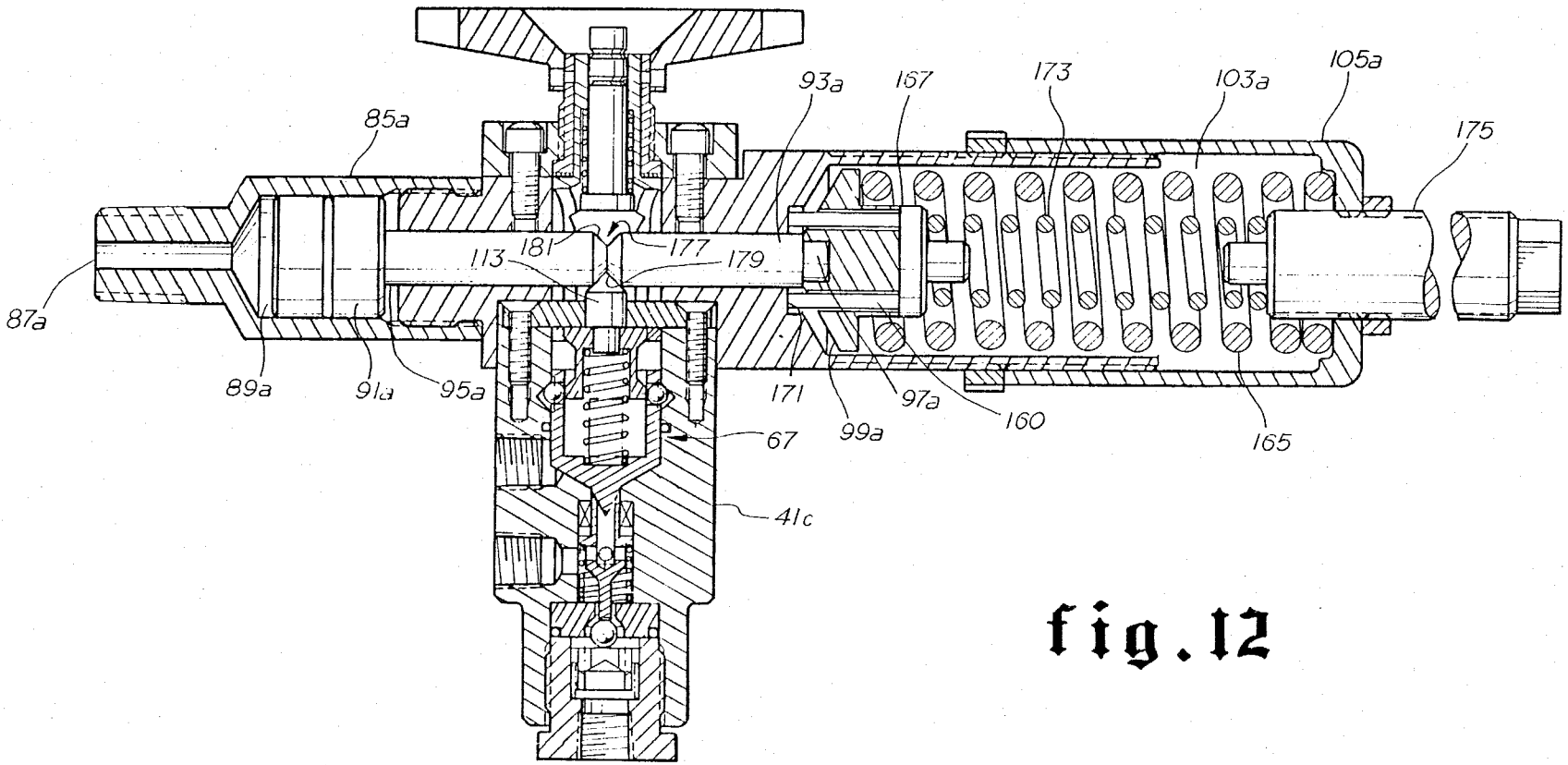

Referring now to FIGS. 10 and 11, there is shown an alternative embodiment of the present invention which is adapted for use as a high or low three-way pneumatic controller. Again, the latch and release means of the embodiment of FIGS. 10 and 11 are substantially the same as those described above. However, the valving in valve body **41*b*** is different.

Valve body **41*b* includes a control inlet 43*b*, a control outlet 147*a* and a bleed outlet 45*b*. A first valve seat 49*a* is defined by a cylindrical bore about passage 47*b* between control outlet 147*a* and bleed outlet 45*b*. A second valve seat 149*a* is defined by a cylindrical bore between control inlet 43*b* and control outlet 147*a***.

The first valve member of the embodiment of FIGS. 10 and 11 is formed by a seal 157 mounted on a rod 159 connected to detent carrier **63*a*. The second valve member is formed by a seal 161 positioned on rod 159. Seals 157 and 161 are spaced axially apart such that when seal 157 is sealingly engaged with first seat 49*a*, second seal 161 is positioned in a radially enlarged bore 163 between control inlet 43*b* and second valve seat 149, as shown in FIG. 10. Thus, when the embodiment of FIGS. 10 and 11 is in service, there is communication between control inlet 43*b* and control outlet 147*a*, but bleed outlet 45*b* is blocked. However, as shown in FIG. 11, when the controller moves out of service, detent carrier 63*a* moves axially upwardly such that second seal 161 engages second seat 149*a* and first seal 157 moves out of engagement with first seat 49*a*, thereby to block control inlet 43*b* and communicate control outlet 149*a* with bleed outlet 45*b***.

Referring now to FIG. 12, there is shown a further alternative embodiment of the present invention which functions as a high and low three-way block and bleed hydraulic pressure controller. The operation of the valves within valve body **41*c* is substantially the same as that of the embodiment of FIGS. 8 and 9, in that latch means 67 is substantially the same as that described above. However, the release means of FIG. 12 is adapted to release latch 67** if service pressure is either high or low.

The release means of the embodiment of FIG. 12 includes an instrument body **85*a* mounted adjacent to valve body 41*c*. Instrument body 85*a* includes a service inlet 87*a* which is adapted to receive and supply service pressure to a chamber 89*a*. A piston 91*a* is slidingly sealingly mounted in chamber 89*a*** and is exposed to service pressure.

An operator **93*a* is longitudinally slidingly mounted within instrument body 85*a*. A first end 95*a* of operator 93*a* abuts piston 91*a* and a second end 97*a*** of operator 93*a* extends into a spring chamber 103*a* of instrument body 85*a* and into engagement with a spring pad 99*a*. A main spring 165 is compressed between a cap 105*a* that is threadedly engaged with instrument body 85*a* and spring pad 99*a*. The force of spring 165 tends to urge spring pad 99*a* and operator 93*a* leftwards against the force generated by service pressure acting on piston 91*a*.

The embodiment of FIG. 12 also includes a secondary spring pad 167 which includes a plurality of legs 169. Legs 169 extend axially through passageways in spring pad 99*a* into abutment with a stop surface 171 in spring chamber 103*a*. A secondary or high spring 173 is compressed between secondary spring pad 167 and a second spring adjustment screw 175 threadedly engaged in the end of cap 105*a*. Secondary spring 173 is adapted together with main spring 165 to oppose rightward movement of operator 93*a* and piston 91*a*. The compression of main spring 165 may be varied by adjusting the axial position of cap 105*a* with respect to instrument body 85*a* and the compression of secondary spring 173 may be adjusted by varying the axial position of secondary spring adjustment screw 175 with respect to cap 105*a*.

Operator 93*a* includes intermediate ends 95*a* and 97*a* a cam portion designated generally by the numeral 177. Cam portion 177 includes opposed conical caming surfaces 179 and 181.

When the controller of FIG. 12 is inservice, cam follower 113 resides between caming surfaces 179 and 181. If service pressure within chamber 89*a* falls below a preselected minimum, main spring 165 urges spring pad 99*a* and operator 93*a* leftward thereby causing caming surface 179 to urge cam follower 113 axially to release latch 67. If, on the other hand, service pressure within chamber 89*a*exceeds the predetermined maximum, piston 91*a* urges operator 93*a* rightward, thereby to move spring pad 99*a* and secondary spring pad 167 to compress springs 165 and 173, respectively. In such event, caming surface 181 urges cam follower 113 axially, again to release latch 67.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompany drawings is to be interpreted as illustrative and not in a limiting sense.

What is claimed is:

1. A pressure controller for controlling control pressure in response to a change in a service pressure, which comprises:

a valve body including a control inlet and a bleed outlet with a passage intercommunicating said control inlet and said bleed outlet;

a first valve seat within said passage between said control inlet and said bleed outlet;

a first valve member reciprocatingly mounted in said passage for movement between a closed position in engagement with said first valve seat to block communication between said control inlet and said bleed outlet and an open position out of engagement with said first valve seat;

means for releasably latching said valve member in said closed position, said latching means including:

(a) a detent recess formed in said valve body;

(b) a detent movably carried with said first valve member;

(c) and a trigger reciprocatingly mounted in said valve body, said trigger including means for urging said detent into engagement with said detent recess when said valve member is in said closed position;

an instrument body mounted adjacent said valve body, said instrument control body including a sense inlet;

a piston reciprocatingly mounted in said instrument body and having a face adapted to be exposed to service pressure received at said sense inlet;

an elongated operator mounted in said instrument body and longitudinally movable with said piston, said operator including a cam portion;

means for urging said operator in the direction opposite the force due to said service pressure acting on said piston;

and a cam follower engaging said cam portion and operably connected to said trigger for releasing said latching means to allow said first valve member to move to said open position.

2. The pressure controller as claimed in claim 1, including means for manually releasing said latch means to allow said first valve member to move to said open position irrespective of said service pressure.

3. The pressure controller as claimed in claim 2, wherein said manual releasing means includes:

a trip yoke having a portion extending outwardly of said instrument body and a portion abuttable with said trigger.

4. The pressure controller as claimed in claim 3 wherein said portion of said trip yoke that is abuttable with said trigger includes a pair of substantially parallel spaced apart legs straddling said operator and cam follower.

5. The pressure controller as claimed in claim 4, including means for urging said legs of said trip yoke into engagement with said trigger.

6. The pressure controller as claimed in claim 5, wherein said portion of said trip yoke that extends outwardly of said instrument body includes means for indicating the position of said trigger.

7. The pressure controller as claimed in claim 1, including means for moving said first valve member from said open position and relatching said latch.

8. The pressure controller as claimed in claim 7, wherein said moving and relatching means includes:

a reset yoke reciprocatingly mounted in said instrument body and including a reset leg extendable into said valve body to transmit closing forces to said first valve member;

and means for moving said reset yoke with respect to said instrument body.

9. The pressure controller as claimed in claim 8, including means for manually releasing said latch means to allow said first valve member to move to said open position.

10. The pressure controller as claimed in claim 9, wherein:

said reset yoke includes a tubular portion having an axially extending bore, said tubular portion being connected to said reset leg and extending outwardly of said instrument body;

and said manual releasing means includes a trip yoke having a portion extending through said reset yoke tubular portion bore outwardly of said instrument body and a portion abuttable with said trigger.

11. The pressure controller as claimed in claim 10, wherein said portion of said trip yoke that is abuttable with said trigger includes a pair of spaced apart legs straddling said operator and cam follower.

12. The pressure controller as claimed in claim 11, including means for urging said leg of said trip yoke into abuttment with said trigger.

13. The pressure controller as claimed in claim 12, including means for indicating the position of said trigger.

14. The pressure controller as claimed in claim 1, wherein said valve body includes:

a control outlet in communication with said passage between said first valve seat and said control inlet;

a second valve seat positioned in said passage between said control inlet and said control outlet;

a second valve member reciprocatingly mounted in said passage for movement between a closed position in engagement with said second valve seat to block communication between said control inlet and said control outlet and an open position out of engagement with said second valve seat to allow communication between said control inlet and said control outlet;

and means for holding said second valve member in said open position when said first valve member is in said closed position and for allowing said second valve member to move to said closed position when said first valve member moves to said open position.

15. The pressure controller as claimed in claim 14, wherein:

said first valve seat includes a tubular portion slidingly sealingly mounted in said passage having a seating surface adjacent an end thereof and including means for urging said tubular portion axially toward said first valve member, said tubular portion being movable between a first axially outward position when said first valve member is closed and a second axially inward position when said first valve member is open;

said second valve seat includes a control flow way surrounded by a seating surface facing outwardly toward said control inlet;

said second valve member includes a valving element movably mounted between said control inlet and said seating surface of said second valve seat;

and said means for holding said second valve member in said open position and for allowing said second valve member to move to said closed position includes a stinger rod attached to said tubular portion of said first valve seat and axially movably therewith, said stinger rod extending through said flow way and having an end abuttable with said valving element, said stinger rod having a length such that when said tubular portion of said first valve seat is in said first axially outward position said valving element of said second valve member is held off said seating surface of said second valve seat and when said tubular portion of said first valve seat is in said second axially inward position said valving element of said second valve engageable with said seating surface of said second valve seat.

16. The pressure controller as claimed in claim 15, including means for urging said valving element of said second valve member toward said second valve seat.

17. The pressure controller as claimed in claim 14, wherein:

said first valve seat is defined by a substantially cylindrical bore positioned about said passage between said control outlet and said bleed outlet, said passage including an enlarged portion between said first valve seat and said bleed outlet;

said second valve seat is defined by a substantially cylindrical bore positioned about said passage between said control inlet and said control outlet, said passage including an enlarged portion between said second valve seat and said control inlet;

said first valve member includes a seal movably mounted in said passage and sealingly engageable with said substantially cylindrical bore defining said first valve seat;

said second valve member includes a seal movably mounted in said second passage and sealingly engageable with said substantially cylindrical bore defining said second valve seat;

and said means for holding said second valve member in said open position and for allowing said second valve member to move to said closed position includes means for maintaining said seals of said first and second valve members in substantially rigidly axially spaced apart relationship such that when said first valve member seal is sealingly engaged with said substantially cylindrical bore defining said first valve seat said second valve member seal is positioned in said enlarged portion of said passage between said second valve seat bore and said control inlet, and when said first valve member seal is in said enlarged portion between said first valve seat bore and said bleed outlet said second valve member seal is in sealing engagement with said second valve seat bore.

18. A pressure controller for controlling a control pressure in response to a change in a service pressure, which comprises:

a valve body including a control inlet and a bleed outlet with a passage interconnecting said control inlet and said bleed outlet;

a first valve seat within said passage between said control inlet and said bleed outlet;

a first valve member reciprocatingly mounted in said passage for movement between a closed position in engagement with said first valve seat to block communication between said control inlet and said bleed outlet and an open position out of engagement with said first valve seat;

a latch for releasably latching said first valve member in said closed position, said latching including a detent recess formed in said valve body, a detent carrier connected to said first valve member and reciprocatingly movable therewith in said valve body, said detent carrier including a detent aperture, a detent carried by said detent carrier and radially movable within said detent aperture, a trigger reciprocatingly mounted in said detent carrier, said trigger including a radially outwardly facing shoulder for engaging said detent and holding said detent radially outwardly into said detent recess when said first valve member is in said closed position, said trigger including a detent recess axially adjacent said radially outwardly facing shoulder, and means for urging said trigger axially to maintain said radially outwardly facing shoulder in engagement with said detents;

and means responsive to a change in said service pressure for moving said trigger axially to allow said detent to move radially into said trigger detent recess, wherein said means for moving said trigger axially includes:

an instrument body mounted adjacent said valve body, said instrument body including a sense inlet in communication with said service pressure;

a piston reciprocatingly movably mounted in said instrument body, said piston being exposed to said control pressure;

an elongated operator mounted in said instrument body and reciprocatingly movable with said piston, said operator including a cam portion;

means for urging said operator in the direction opposite the force due to said service pressure acting on said piston;

and a cam follower engaging said cam portion of said operator and said trigger.

19. The pressure controller as claimed in claim 18, wherein said valve body includes:

a control outlet in communication with said passage between said first valve seat and said control inlet;

a second valve seat positioned in said passage between said control inlet and said control outlet;

a second valve member reciprocatingly mounted in said passage for movement between a closed position in engagement with said second valve seat to block communication between said control inlet and said control outlet and an open position out of engagement with said second valve seat to allow communication between said control inlet and said control outlet;

and means for holding said second valve member in said open position when said first valve member is in said closed position and for allowing said second valve member to move to said closed position when said first valve member moves to said open position.

20. The pressure controller as claimed in claim 19, wherein:

said first valve seat is defined by a substantially cylindrical bore positioned about said passage between said control outlet and said bleed outlet, said passage including an enlarged portion between said first valve seat and said bleed outlet;

said second valve seat is defined by a substantially cylindrical bore positioned about said passage between said control inlet and said control outlet, said passage including an enlarged portion between said second valve seat and said control inlet;

said first valve member includes a seal movably mounted in said passage and sealingly engageable with said substantially cylindrical bore defining said first valve seat;

said second valve member includes a seal movably mounted in said second passage and sealingly engageable with said substantially cylindrical bore defining said second valve seat;

and said means for holding said second valve member in said open position and for allowing said second valve member to move to said closed position includes means for maintaining said seals of said first and second valve members in substantially rigidly axially spaced apart relationship such that when said first valve member seal is sealingly engaged with said substantially cylindrical bore defining said first valve seat said second valve member seal is positioned in said enlarged portion of said passage between said second valve seat bore and said control inlet, and when said first valve member seal is in said enlarged portion between said first valve seat bore and said bleed outlet said second valve member seal is in sealing engagement with said second valve seat bore.

21. A pressure controller for controlling control pressure in response to a change in a service pressure, which comprises:

a valve body including a control inlet and a bleed outlet with a passage intercommunicating said control inlet and said bleed outlet;

a first valve seat within said passage between said control inlet and said bleed outlet;

a first valve member reciprocatingly mounted in said passage for movement between a closed position in engagement with said first valve seat to block communication between said control inlet and said bleed outlet and an open position out of engagement with said first valve seat;

means for releasably latching said valve member in said closed position;

an instrument body mounted adjacent said valve body, said instrument control body including a sense inlet;

a piston reciprocatingly mounted in said instrument body and having a face adapted to be exposed to service pressure received at said sense inlet;

an elongated operator mounted in said instrument body and longitudinally movable with said piston, said operator including a cam portion;

means for urging said operator in the direction opposite the force due to said service pressure acting on said piston;

and a cam follower engaging said cam portion and operably connected to said latching means for releasing said latching means to allow said first valve member to move to said open position, wherein said latching means includes:

a cylindrical detent carrier connected to said first valve member for reciprocating movement therewith in said valve body, said detent carrier including a plurality of detent apertures spaced circumferentially thereabout;

a plurality of detents carried by said detent carrier radially movably within said detent aperture;

a detent recess groove formed in said valve body;

a trigger reciprocatingly mounted in said detent carrier and operably interconnected with said cam follower, said trigger including a radially outwardly facing shoulder for engaging said detents and holding said detents radially outwarding into said detent recess when said first valve member is in said closed position;

a detent recess formed in said trigger axially adjacent said radially outwardly facing shoulder;

and means for urging said trigger in a first axial direction to maintain said radially outwardly facing shoulder in engagement with said detents.

* * * * *